US007292144B2

(12) United States Patent
Ballinger

(10) Patent No.: US 7,292,144 B2
(45) Date of Patent: Nov. 6, 2007

(54) APPARATUS AND METHOD FOR CONTACT-LESS SWITCHING

(75) Inventor: Forrest Henry Ballinger, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 464 days.

(21) Appl. No.: 10/958,776

(22) Filed: Oct. 5, 2004

(65) Prior Publication Data

US 2005/0110482 A1 May 26, 2005

Related U.S. Application Data

(60) Provisional application No. 60/525,508, filed on Nov. 26, 2003.

(51) Int. Cl.
*G08B 21/00* (2006.01)

(52) U.S. Cl. ..... 340/540; 340/999; 340/933; 324/217; 324/117 R; 246/122; 246/246

(58) Field of Classification Search ..... 340/540
See application file for complete search history.

(56) References Cited

U.S. PATENT DOCUMENTS 1,605,525 A * 11/1926 Bushnell ..... 246/63 A
2,243,727 A * 5/1941 Bone ..... 246/319
2,667,048 A * 1/1954 Whitfield ..... 464/7
2,691,722 A * 10/1954 Lewis ..... 246/246
2,848,602 A * 8/1958 Post ..... 246/246
2,896,069 A * 7/1959 Wight ..... 246/169 R
3,054,475 A * 9/1962 Moser et al. ..... 187/280
3,531,792 A * 9/1970 Bagno et al. ..... 340/521
3,558,875 A * 1/1971 Gieskieng ..... 246/169 R
6,412,332 B1 * 7/2002 Bartonek ..... 73/12.01
6,691,958 B2 * 2/2004 Biagiotti ..... 246/415 R
2002/0175812 A1 * 11/2002 Hofmann et al. ..... 340/545.2

* cited by examiner

*Primary Examiner*—Benjamin C. Lee
*Assistant Examiner*—Eric M Blount
(74) *Attorney, Agent, or Firm*—Senniger Powers

(57) ABSTRACT

An apparatus and method for use with a railroad dragging equipment detecting (DED) system that detects objects hanging from and dragged beneath a train as the train travels along rails of a railroad track. A generator supplies a first signal and is coupled to a magnetic amplifier coil to form a magnetically variable impedance circuit. The magnetic amplifier coil is responsive to the first signal to create a circuit impedance in series with a detection circuit. A magnet is mechanically connected to the cam/follower system and is positioned near the magnetic amplifier core for varying a circuit impedance of the detection circuit. A detection circuit generates a second signal as a function of variations in circuit impedance. A controller is responsive to the second signal for activating an alarm when the magnet moves relative to the magnetic amplifier coil.

27 Claims, 13 Drawing Sheets

APPARATUS AND METHOD FOR CONTACT-LESS SWITCHING

FIELD OF THE INVENTION

The invention relates generally to railway dragging equipment detection (DED) systems. More particularly, the invention relates to an improved switching apparatus for activating an alarm when the DED system detects objects or equipment dragging beneath a train.

BACKGROUND OF THE INVENTION

To reduce the risk of derailment and other potential damage caused by dragging objects, DED systems or "draggers" have been used to detect the presence of objects dragging beneath a moving train. As an example, draggers may be placed at twenty (20) mile intervals over long stretches of a railroad track, in conjunction with other defect detection equipment. If a dragging object is detected, the train is stopped so that the object can be secured to reduce the potential for derailment or other problems. The height of the dragger is determined by balancing the risk of not detecting an object (such as an air hose), which is not dragging very far below the bottom of the train against the likelihood of unnecessarily stopping the train numerous times. For mainline applications, draggers are usually set at a height of about one inch below the top rail so that only objects hanging well below the train will be detected. Air hose detectors, on the other hand, typically extend a couple of inches above the top rail. Consequently, air hose detectors are primarily used in railroad yards rather than open stretches of track so that fast-moving trains will not have to make frequent stops to secure low-risk objects.

One conventional dragger rotates on a shaft between a non-impact position and an impact position. A mechanical contact such as a cam/follower mechanism detects an impact when the dragger is forced into its impact position. The cam/follower mechanism translates the rotational motion of the shaft into a linear motion. The linear motion is used to actuate a conventional switching mechanism to energize an alarm coupled to a switching circuit. For example, a switch, which is closed when the dragger is in its non-impact position, opens when the dragger moves or rotates to its impact position. Moreover, this switch is connected to a relay, which activates an alarm when the switch is opened by an impact, which causes the dragger to rotate.

The conventional switching mechanism employed by draggers described above has several drawbacks. Because it relies upon moving parts, it requires considerable maintenance (e.g., lubrication and adjustment). In colder climates, ice may accumulate in or on such switching mechanisms and inhibit operation of the switch. In addition, moisture and exposure can cause corrosion of one or more of the moving parts, which can result in unreliable operation of the switch.

Other conventional switching mechanisms use proximity sensors to detect the position of an object. However, such switching mechanisms are configured with three-conductor (i.e., wires) for connection to a circuit, and, thus, cannot be used with an existing switching mechanism configured for connection to a two-wire circuit. As a result, to use a conventional switching mechanism having a proximity sensor in connection with a two-wire circuit would require the replacement of the existing two-wire switching mechanism and/or the installation of at least another conductor (i.e., wire) for proper operation.

Thus, there is a need for a switch that relies less on moving parts and that can be used by existing draggers and/or other switching circuit configurations, and that is more reliable.

SUMMARY OF THE INVENTION

The invention meets the above needs and overcomes one or more deficiencies in the prior art by providing an improved apparatus and method for detecting a position of a switching mechanism used to indicate a position of an object having a first position and a second position. In one embodiment, the invention uses existing components of the switching mechanism to vary the location of a magnet relative to a magnetically variable inductor to detect a position of the object. Moreover, the invention uses existing conductors connected to the switching mechanism to transmit a signal indicative of the position of the object to a remote location. By using the existing switching mechanism only the magnetically variable inductor and magnet are exposed to the harsh environment of the track location, and the existing wires connecting the existing contact switching mechanism 126 can be used to transmit the signal to a position detection circuit located within a shelter such as a signal house. The features of the present invention described herein are more efficient and easier to implement than currently available techniques as well as being economically feasible and commercially practical.

In one aspect of the invention, an apparatus is provided for use with a railroad dragging equipment detecting (DED) system that detects objects hanging from and dragged beneath a train as the train travels along rails of a railroad track. The DED system includes an impact element fixedly mounted to a shaft extending generally between the rails. The impact element includes at least one surface that will be impacted by any object hanging down from said train below the top of the impact surface when the train and hanging object pass the impact element. Upon impact, the impact element rotates from a first position to a second position. A cam/follower system translates the rotational motion of the impacted element to a linear movement. The apparatus includes a generator for supplying an input signal. The apparatus also includes a magnetic amplifier coil coupled to the generator to form a circuit, which is responsive to the supplied input signal to generate an impedance in the circuit. The magnetic amplifier coil is wound on a magnetic amplifier core. The apparatus also includes a magnet generating a first magnetic field positioned near the magnetic amplifier core for affecting the impedance in the circuit. The magnet is mechanically connected to the cam/follower system, and the cam/follower system moves the magnet relative to the magnetic amplifier coil when the impact element rotates from the first position to the second position. Moving the magnet relative to the magnetic amplifier coil varies the circuit impedance. The apparatus also includes a detection circuit for generating an output signal as a function of variations in circuit impedance. The apparatus further includes a controller that is responsive to the output signal for activating an alarm when the magnet moves relative to the magnetic amplifier coil.

In another aspect of the invention, an apparatus is provided for detecting a position of a switching mechanism. The switching mechanism indicates a position of an object having a first position and a second position. The apparatus includes a generator for supplying an input signal. The apparatus also includes a magnet located near the magnetic amplifier core for varying the impedance of the circuit. The magnet is mechanically connected to the switching mechanism, and has a first location relative to the magnetic amplifier coil when the object is in the first position magnet and has a second location relative to the magnetic amplifier coil when the object is in the second position. The impedance of the circuit when the magnet is in the first location is different than the impedance of the circuit when the magnet is in the second location. The apparatus also includes a detection circuit for generating an output signal as a function of variations in circuit impedance. The apparatus also further includes a controller that responsive to the output signal for activating an alarm when the magnet moves relative to the magnetic amplifier coil.

In another aspect of the invention, a method is provided for detecting mechanical movement of a switching mechanism. The switching mechanism indicates movement of an object between a first position and a second position. The method includes supplying an alternating current (a.c.) input signal to generate an impedance in the magnetic amplifier circuit. The circuit includes a magnetically variable inductor responsive to the a.c. signal for generating the impedance in the circuit. The method also includes varying a location of a first magnetic field relative to the magnetically variable inductor. The magnetically variable inductor is responsive to the location of the first magnetic field to vary the circuit impedance. The location of the first magnetic field corresponds to a position of an impact element. The location of the first magnetic field varies when the switching mechanism moves from a first position to a second position. Changing the location of the first magnetic field relative to the magnetically variable inductor varies the circuit impedance. The method also includes generating an output signal as a function of variations in the circuit impedance. The method further includes selectively activating an alarm as a function of the generated output signal.

In yet another aspect of the invention, an apparatus is provided for detecting a position of a switching mechanism. The switching mechanism indicating a position of an object having a first position and a second position. The apparatus includes a signal generator for supplying an input signal. The apparatus also includes a magnetic amplifier coil coupled to the signal generator via a first conductor and a second conductor to form a circuit which is responsive to the supplied input signal to affect an impedance of the circuit. The magnetic amplifier coil includes a coil being wound on a magnetic amplifier core. The apparatus also includes a magnet located near the magnetic amplifier core for varying the impedance of the circuit. The magnet is mechanically connected to the switching mechanism, and has a first location relative to the magnetic amplifier coil when the object is in the first position magnet and has a second location relative to the magnetic amplifier coil when the object is in the second position. The impedance of the circuit when the magnet is in the first location is different than the impedance of the circuit when the magnet is in the second location. The apparatus includes a detection circuit for generating an output signal as a function of variations in circuit impedance. The apparatus also includes a controller responsive to the output signal for activating an alarm when the magnet moves relative to the magnetic amplifier coil. The magnetic amplifier coil and magnet operate as a contactless switching mechanism to vary current flow in the circuit.

Other aspects and features of the present invention will be in part apparent and in part pointed out hereinafter.

BRIEF DESCRIPTION OF THE DRAWINGS

Corresponding reference characters and designations generally indicate corresponding parts throughout the drawings.

DETAILED DESCRIPTION

Railway dragging equipment detection systems provide notice of improperly connected equipment such as pneumatic braking lines by detecting hanging or dragging train loads or equipment and activating alarms to notify the appropriate personnel.

Figure 1A:
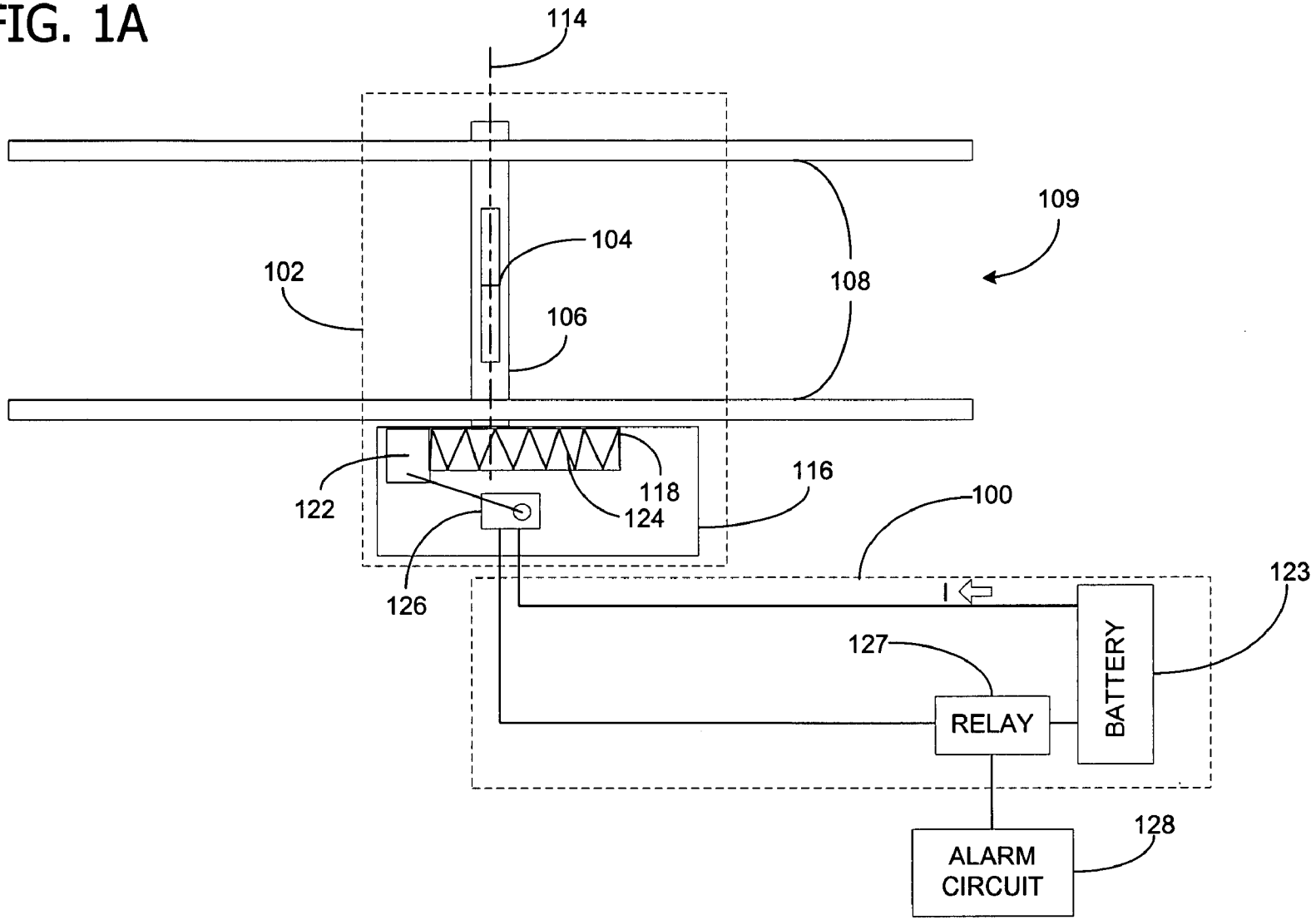
FIGS. 1A and 1B illustrate an existing switching circuit before and after the DED system detects a dragged object.
Figure 1B:
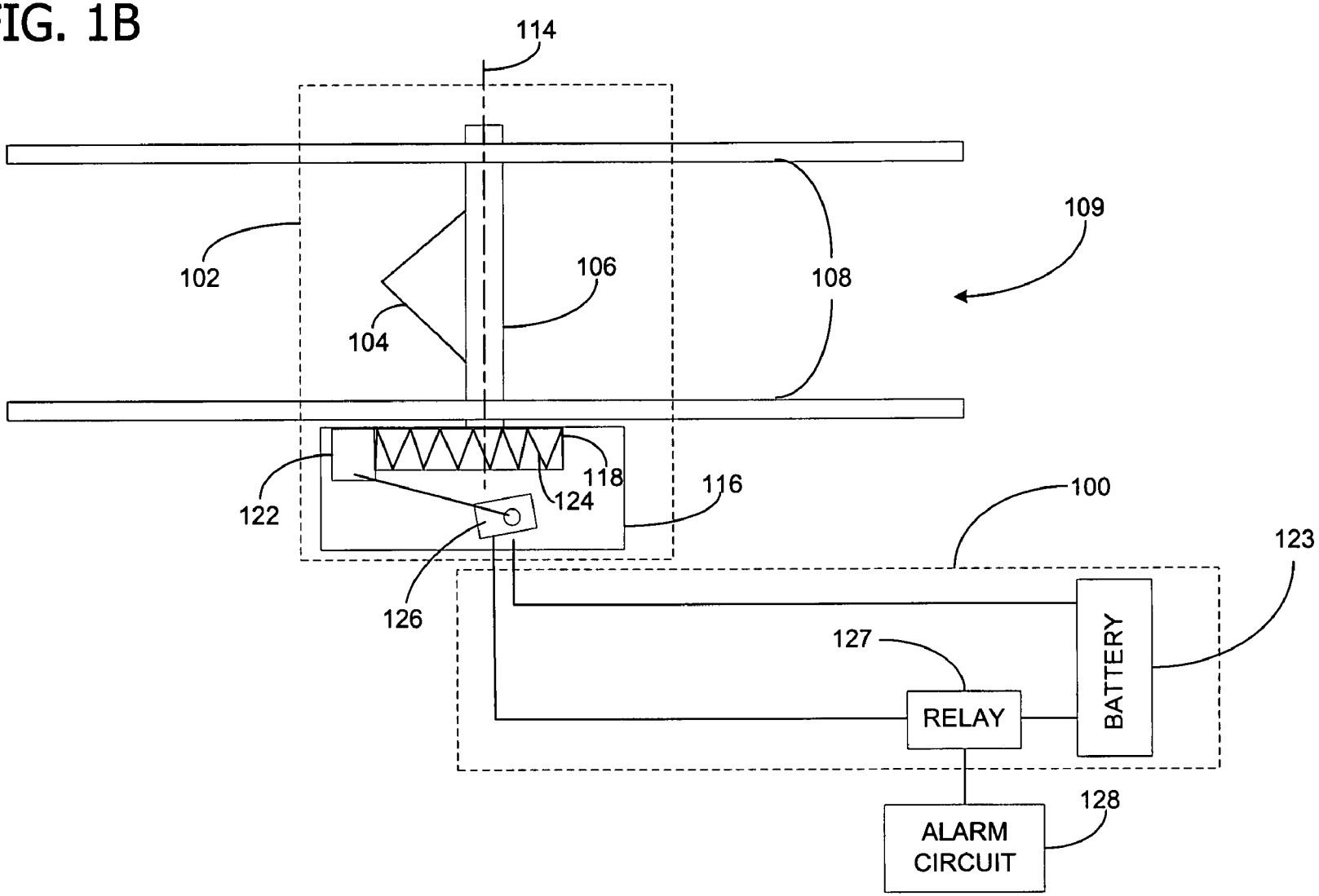
Figure 1C:
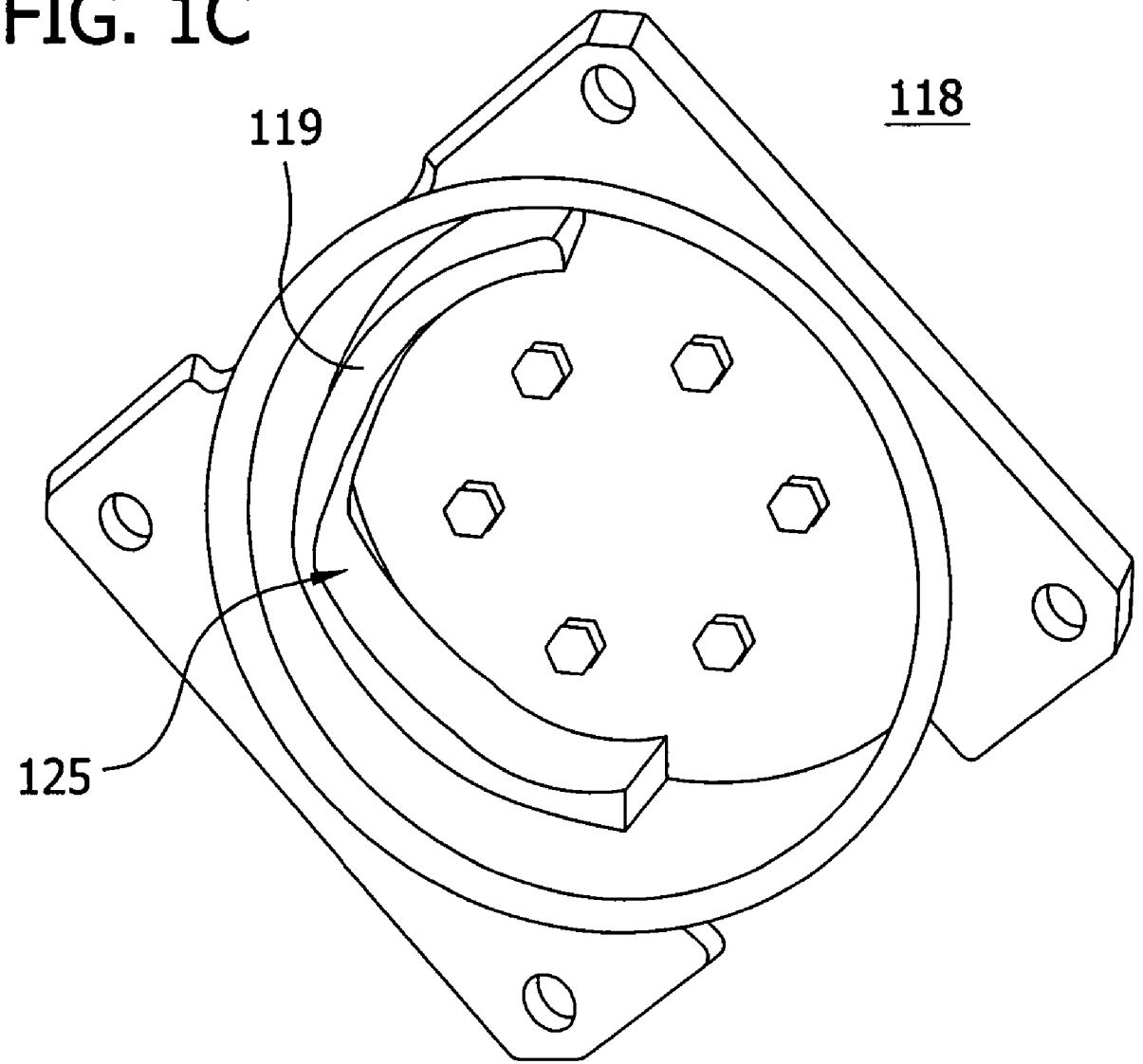
FIG. 1C illustrates a CAM component of a cam/follower mechanism.
Figure 1D:
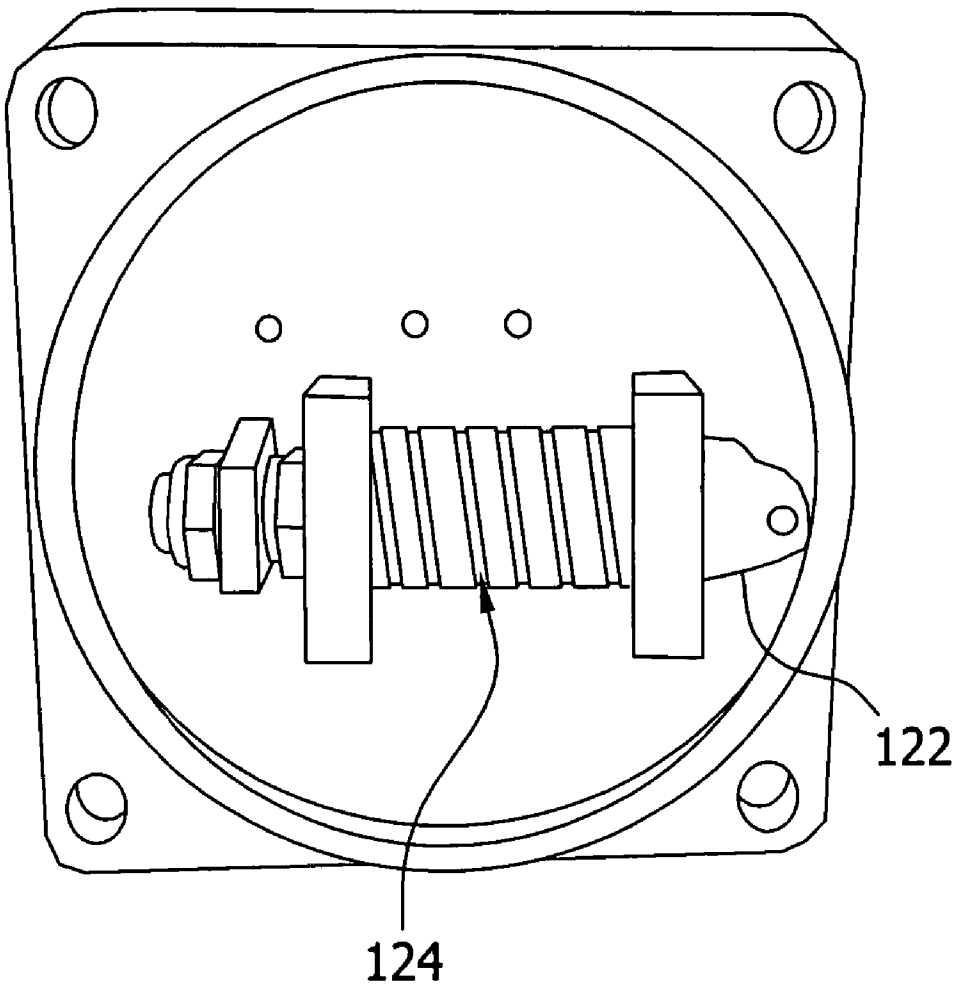
FIG. 1D illustrates a follower component of a cam/follower mechanism.
Figure 1E:
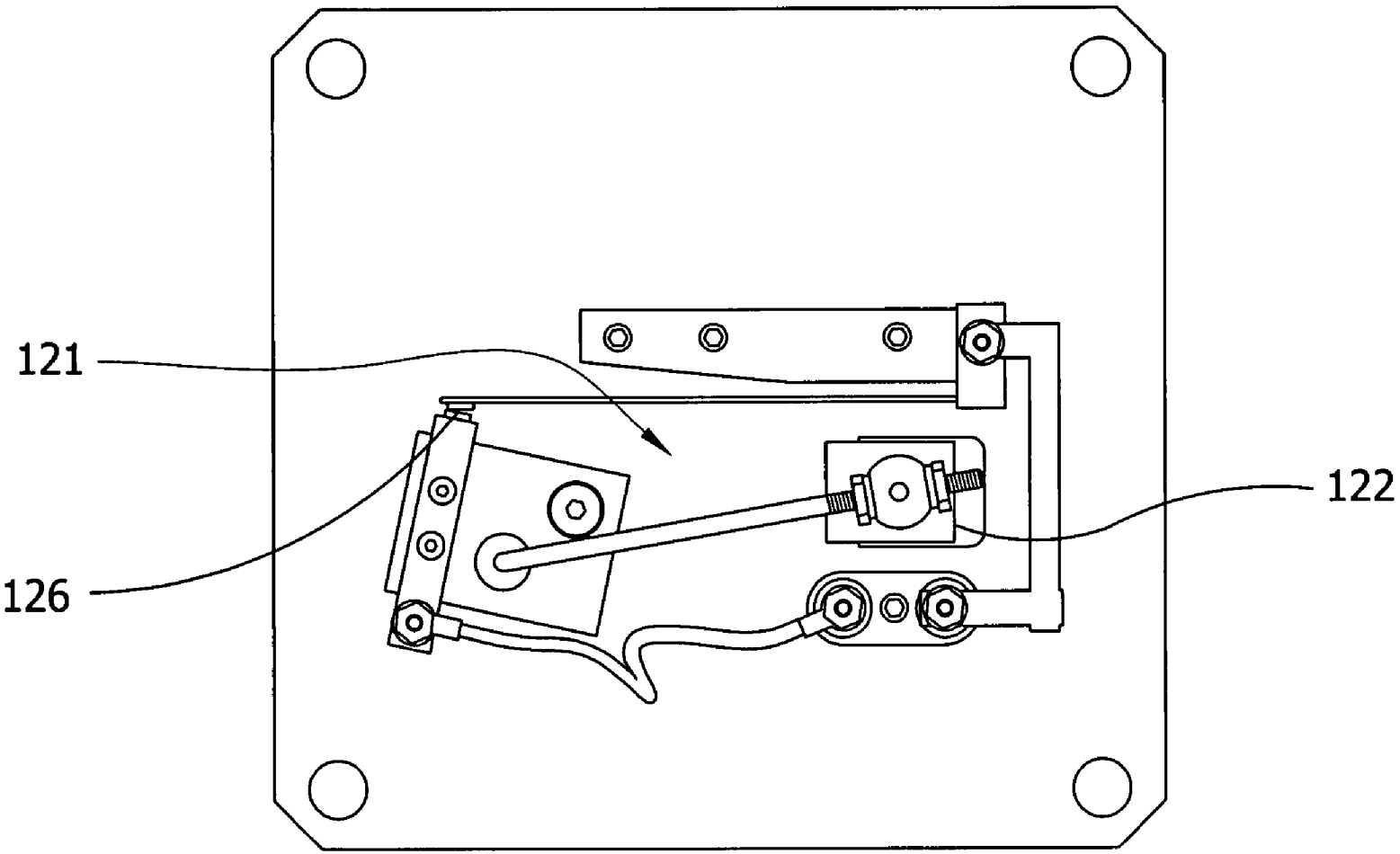
FIG. 1E illustrates an existing switching apparatus used in an existing switching circuit.
Figure 1F:
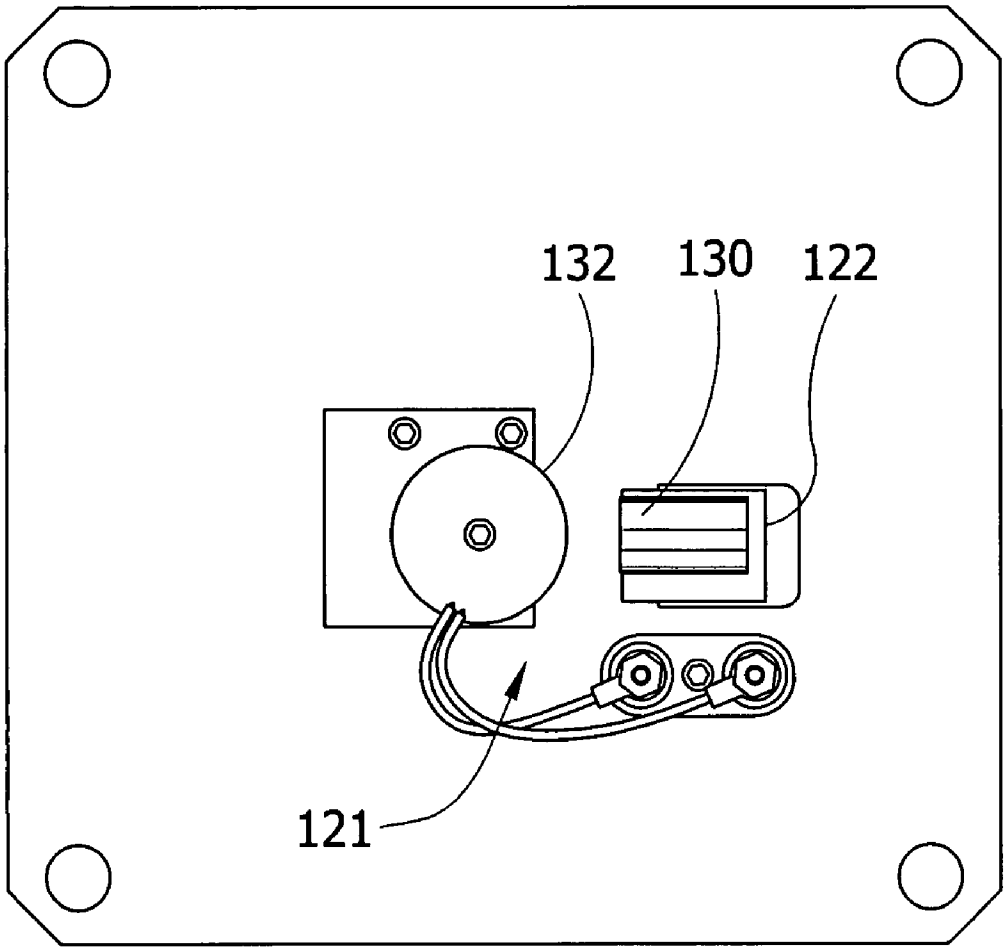
FIG. 1F illustrates a switching apparatus used in a switching circuit according to one preferred embodiment of the invention.

Referring now to FIGS. 1A and 1B, an existing switching circuit, indicated generally at 100, is shown for use with a DED system, indicated generally at 102. The switching circuit 100 includes a battery 123 for energizing a detector 127 (e.g., relay coil) connected in series with the battery. The DED system 102 includes an impact element 104, or paddle, fixedly mounted to a shaft 106. The shaft 106 extends between a pair of rails 108 of a railroad track 109, and is aligned such that it is generally perpendicular to the rails 108. The impact element 104 is positioned substantially vertical and upward (See FIG. 1A) such that it impacts an object suspended or hanging down from a train traveling along the track 109 when the train and object pass the impact element 104. After impacting an object, the impact element 104 moves or rotates downward (see FIG. 1B) toward a horizontal position from the initial vertical upward position (i.e., non-impact position) causing the shaft 106 to rotate about an axis 114. One end of the shaft 106 is positioned in a housing 116 for enclosing a cam 118 and follower 122. The cam 118 and follower 122 translate the rotational motion of the shaft into a linear displacement. As known to those skilled in the art, the cam 118 can be a metal plate with a curved member 119, or profile, (See FIG. 1C) used to impart a linear motion on the follower 122 (See FIG. 1D) to operate a switching mechanism 126. In this case, a spring 124 is used to push the follower 122 (See FIG. 1D) against the curved member 119 of the cam 118. When the impact element 104 is in the initial vertical upward position, spring 124 pushes the follower 122 against a recessed portion 125 of the curved member 119. When the shaft 106 rotates, the curved member 119 (See FIG. 1C) simultaneously rotates such that the elongated portion 125 of the curved member of the cam 118 moves away from the follower 122, and the curved member 119 pushes the follower 122 in a linear direction. Thus, the rotational motion of the shaft 106 is translated into a linear motion. The switching circuit 100 includes a battery 123 for energizing a relay 127 having normally closed contacts connected in series with the battery 123. The linear motion is used to open the switching mechanism contact 126 (See FIG. 1E) and de-energize the relay 127 causing the relay contacts to close, which activates an alarm 128 coupled to the switching circuit 100. In other words, the normally closed switching mechanism contact 126 within the DED system 102 causes the relay 127 to be continually energized by the battery 123. When the impact element is moved downward from the vertical upward position by a low hanging object from a train, the switching mechanism contact 126 opens, the relay drops to its normally closed position, and the alarm 128 is activated to advise an operator or engineer that a dragged or suspended object has been detected by the DED system 102. As described above, prior switching mechanisms 126 rely heavily on moving parts, and are therefore less reliable than the contact-less switch of the invention. The switching mechanism 121 of invention uses a magnetic field generated by a magnet 130 that is mounted to the follower 122 to change the impedance of a magnetic amplifier coil 132 in a switching circuit when the cam 118 and follower 122 translate the rotational motion of the shaft into a linear displacement (See FIG. 1F).

Figure 2A:
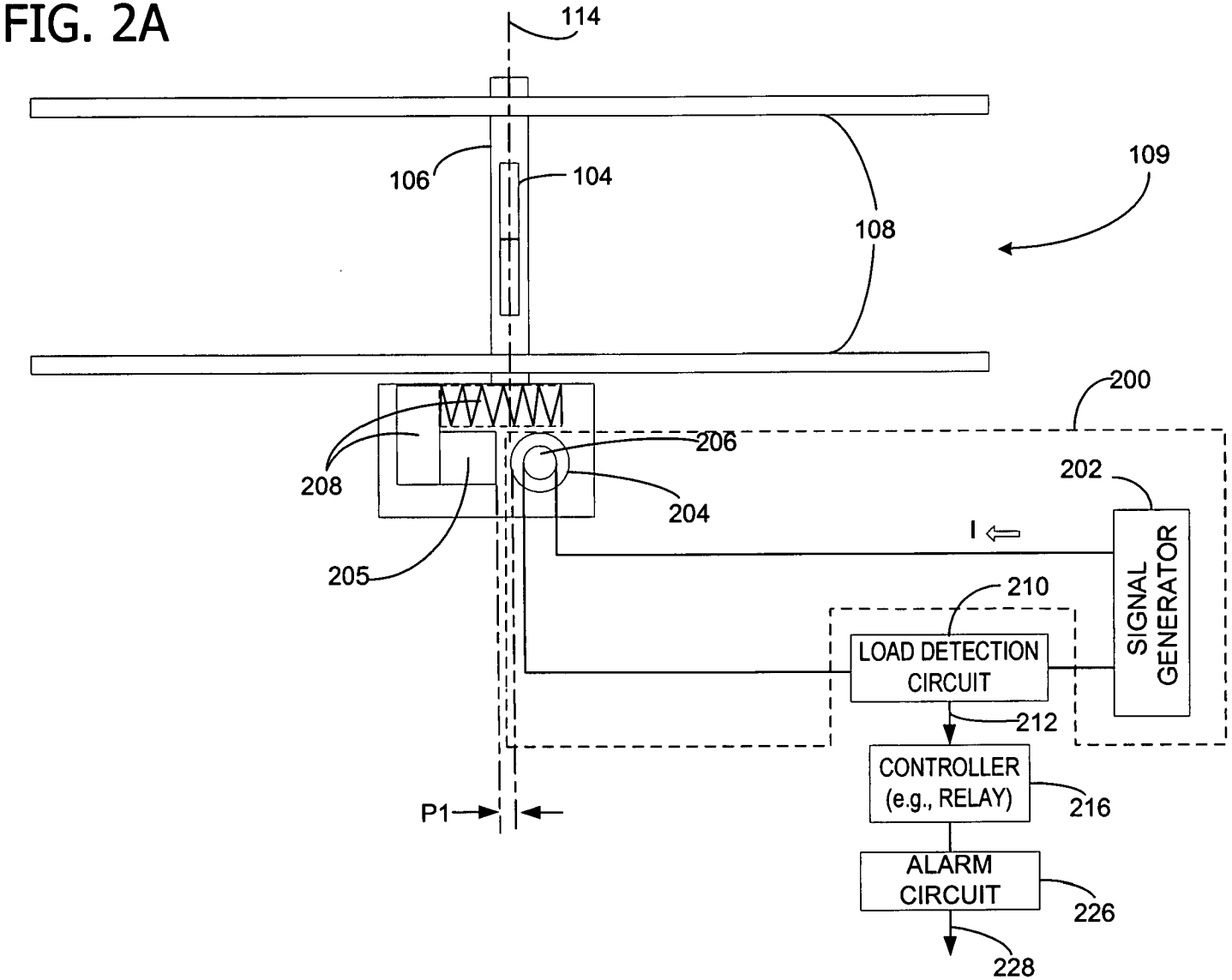
FIGS. 2A and 2B are schematic illustrations of a switching circuit for use with a railway DED system according to one preferred embodiment of the invention.
Figure 2B:
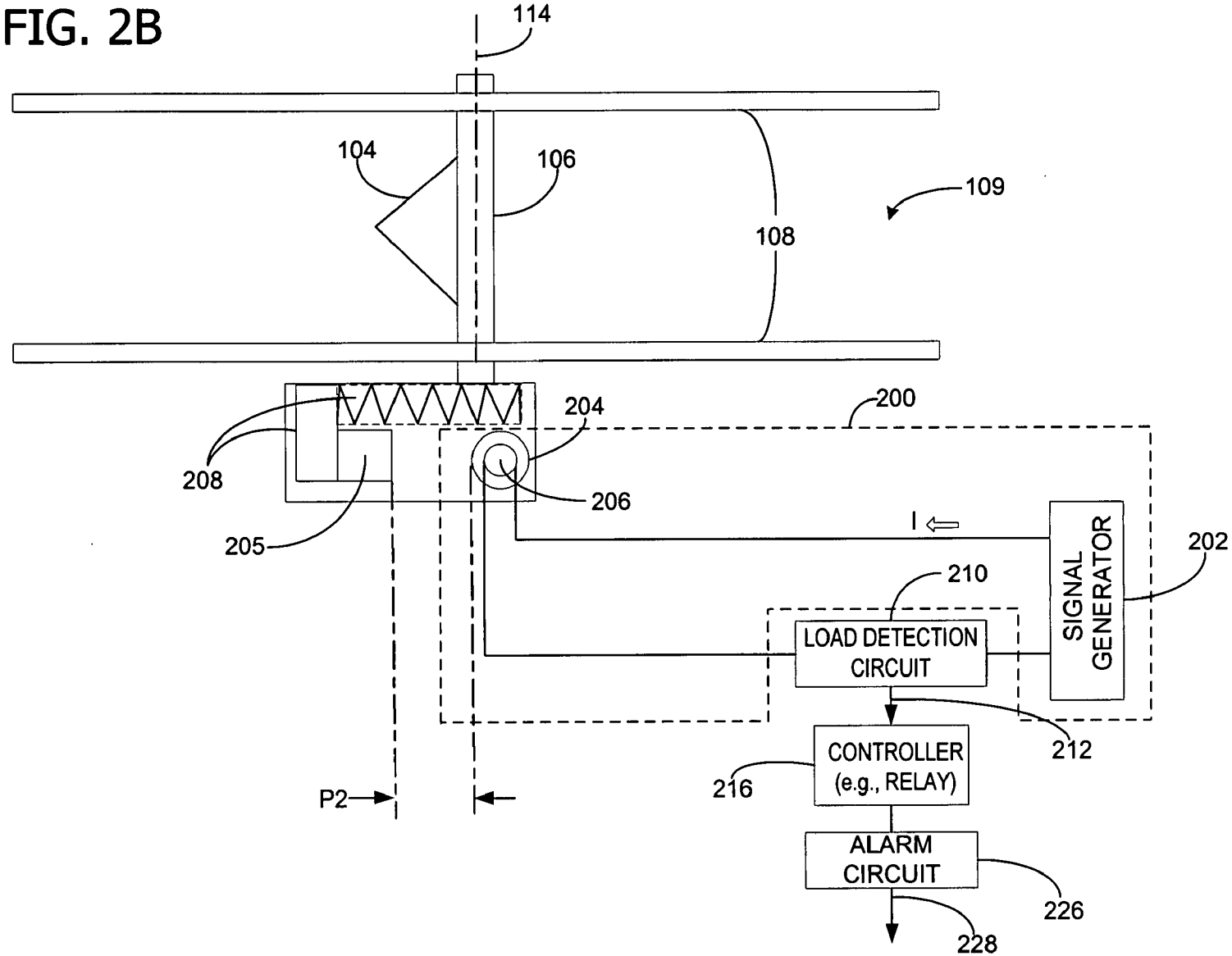

Referring now to FIGS. 2A and 2B, schematic diagrams illustrate a switching circuit 200 for use with a railway DED system according to one preferred embodiment of the invention. A sine wave generator 202 generates and supplies an alternating current (ac) voltage signal (e.g., 12 volts) to the switching circuit 200. No specific ac frequency is required; however, due to component size, it is desirable for the frequency to be above 1 kHz. For example, 9 kHz may be used. The required ac voltage is dependent upon load requirements. A magnetic amplifier coil 204 (e.g., amplifier coil 132) is coupled to the generator 202 and responsive to the supplied ac voltage signal and location of a magnet 205 (e.g., magnet 130) to vary the impedance of the switching circuit 200. More specifically, the magnetic amplifier coil operates as a magnetically variable inductor when the location of the magnet 205 is changed relative to the magnetic amplifier coil 204 to change the inductance of the coil 204. For example, when the magnet 205 is located substantially near a magnetic amplifier core 206 of coil 204 the permeability of the magnetic amplifier core 206 is saturated and the inductance of coil 204 is reduced. As another example, when the magnet 205 is moved away from the magnetic amplifier core 206 the permeability of the core 206 is increased and the inductance of the coil 204 is increased. As known to those skilled in the art, increasing the inductance of the magnetic amplifier coil increases the impedance of the magnetic amplifier coil 204, and decreasing the inductance of the magnetic amplifier coil 204 decreases the impedance of the magnetic amplifier coil 204. Moreover, increasing the impedance of the magnetic amplifier coil 204 reduces the amount of current (I) flowing through the switching circuit 200, and decreasing the impedance of the magnetic amplifier coil 204 increases the amount of current (I) flowing through the circuit 200.

In one embodiment, the magnet 205 is mechanically connected to a cam/follower mechanism 208 (e.g., cam 118, follower 122) for moving the magnet 205 from a first position P1 to a second position P2 relative to the magnetic amplifier coil 204. The first position P1 of the magnet 205 (See FIG. 2A) is within or substantially near the core 206 of the magnetic amplifier coil 204, and the second position P2 of the magnet 205 (See FIG. 2B) is further away from the core 206 of the magnetic amplifier coil 204. In other words, the cam/follower mechanism 208 moves the magnet 205 away from the magnetic amplifier coil 204 when the impact element 104 moves downward from the initial upward position. Thus, the magnetic amplifier coil 204, magnet 205, cam 118, and follower 122 operate as a contact-less switching mechanism to vary current flow, e.g., to impede or allow current to flow in the switching circuit 200. Notably, although the contact-less switching mechanism is described herein as the combination of the magnetic amplifier core 206, coil 204 and magnet 205, it is contemplated that other magnetically variable inductors and configurations can be used to implement the invention.

A load detection circuit 210 is responsive to the current I flowing through the switching circuit 200 to generate a direct current (dc) output voltage signal 212. A controller 216 such as a relay is coupled to the load detection circuit 210 and responsive to the dc output voltage signal 212 to provide the output voltage signal 212 to an alarm circuit 226. For example, in one embodiment, the relay 216 includes contacts having a normally closed position. That is, when the dc output voltage signal 212 is low (e.g., less than five volts) the relay contacts are closed, and when the dc output voltage signal 212 is high (e.g., greater than five volts) the relay contacts are open. The alarm circuit 226 monitors the relay 216 to detect a closed circuit condition, and generates an alarm signal 228 when a closed circuit is detected. The alarm signal 228 can be used to activate visual and/or audible alarms such as a Hot Box Detector equipped with a Talker feature to transmit a voice alarm via radio, or an interconnection to the signal system to provide a visual alarm. Notably, the detection circuit and components of the switching circuit can be at a remote location from the contact-less switching mechanism. More specifically, only the magnetic amplifier coil 204 and magnet 205 are in the harsh environment of the track location, whereas the signal generator 202, the detection circuit and alarm circuitry can be located within a shelter such as a signal house. It is also notable, that the existing wires connecting the existing contact switching mechanism 126 can be used to connect amplifier coil 204 to the detection circuit.

Figure 3:
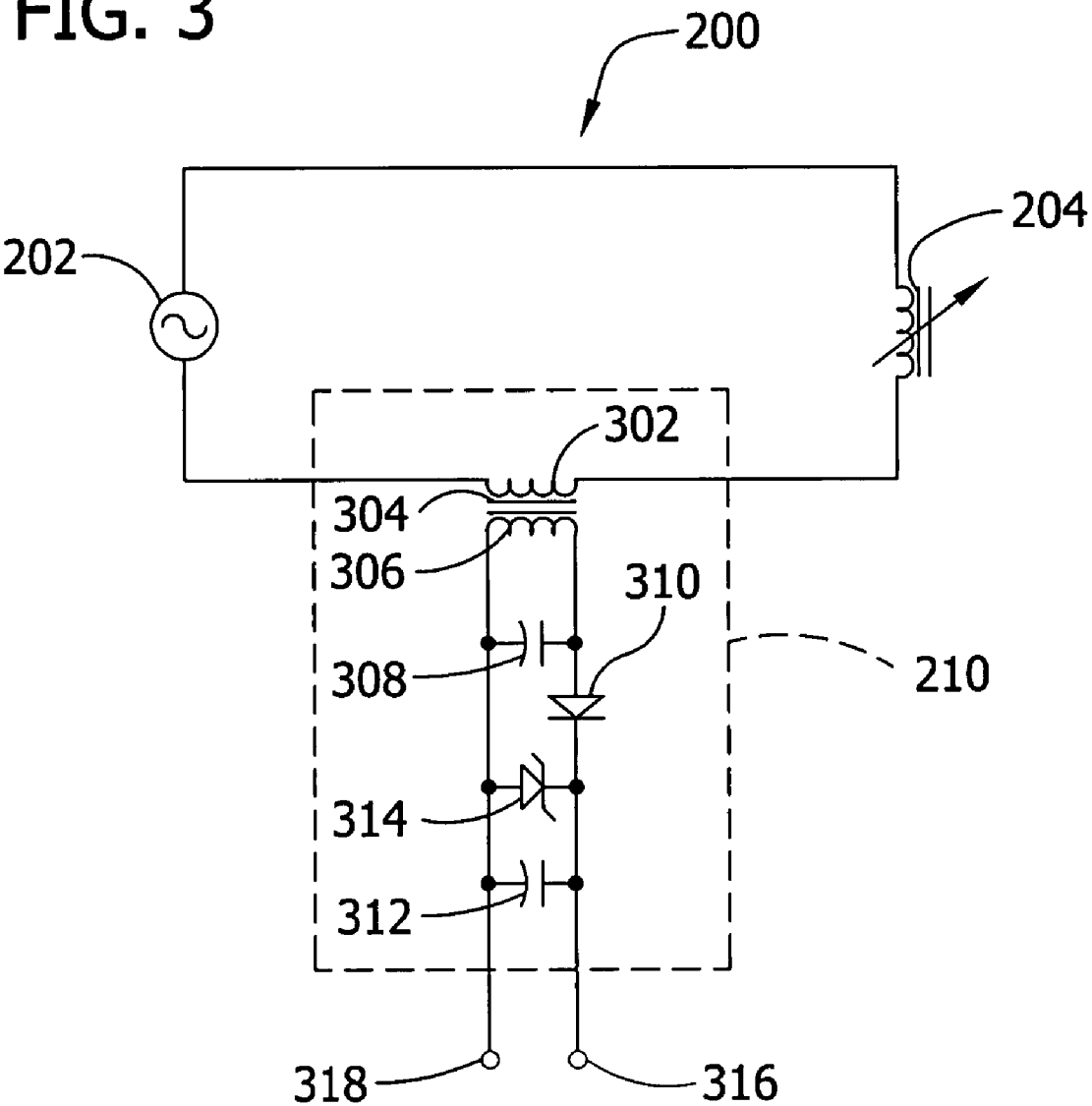
FIG. 3 is a schematic illustration of a load detection circuit suitable for use in one preferred embodiment of the invention.

Referring next to FIG. 3, a schematic diagram illustrates components of a load detection circuit 210 according to one preferred embodiment of the invention. A detector transformer core 304 having a primary winding 302 and secondary winding 306 is arranged having primary winding 302 in series with the magnetic amplifier coil 204. When the impedance of the magnetic amplifier coil 204 is reduced, current flows and passes through the primary winding 302 of the detector transformer 304 producing an increased primary voltage. The windings 302, 306 are configured to step up the primary voltage and produce a secondary voltage or ac output voltage signal across the secondary winding 306 of the detector transformer 304. In one embodiment, the primary winding 302 has 70 turns and the secondary winding 306 has 350 turns. Thus, the secondary voltage produced across the secondary winding will have magnitude approximately five times greater than the primary voltage.

A tuning capacitor 308 is arranged in parallel with the secondary coil to tune the output voltage. Tuning the transformer secondary 306 with capacitor 308 raises the impedance without vastly increasing the inductance (number of turns required) of the transformer. The tuned output voltage signal is rectified by a series diode 310 to provide dc output voltage signal. A zener diode 314 is used to limit the DC output voltage. In one embodiment, the zener diode 314 limits output voltage to approximately 12 Volts DC. A smoothing capacitor 312 is used to reduce ripple on the output voltage via leads 316, 318.

In operation, when the impact element 104 is in the upward position (FIG. 2A), the magnet 205 attached to the cam/follower mechanism 208 is positioned within or substantially near the magnetic amplifier coil 204. When the magnet 205 is within or near the magnetic amplifier coil 204, the impedance of the coil 204 decreases and increases the amount of current I flowing through the switching circuit 200. The increased current flowing through the detector transformer 304 generates a higher dc output voltage that energizes the normally closed relay 216 (FIG. 2A) to open the contacts. The alarm circuit 226 detects an open circuit and an alarm signal 228 is not generated. When the impact element 104 is in the downward position (FIG. 2B), the cam/follower mechanism 208 causes the magnet 205 to move away from the core 206 of the magnetic amplifier coil 204. When the magnet 205 moves away from the magnetic amplifier coil 204, the impedance of the coil 204 increases, and decreases the amount of current, (I), flowing through the switching circuit 200. The reduced current through detector transformer generates a lower dc output voltage resulting in the relay 216 contacts closing. The alarm circuit 226 detects a closed circuit and generates an alarm signal 228 that can be used to activate visual and/or audible alarms such as described above.

Figure 4:
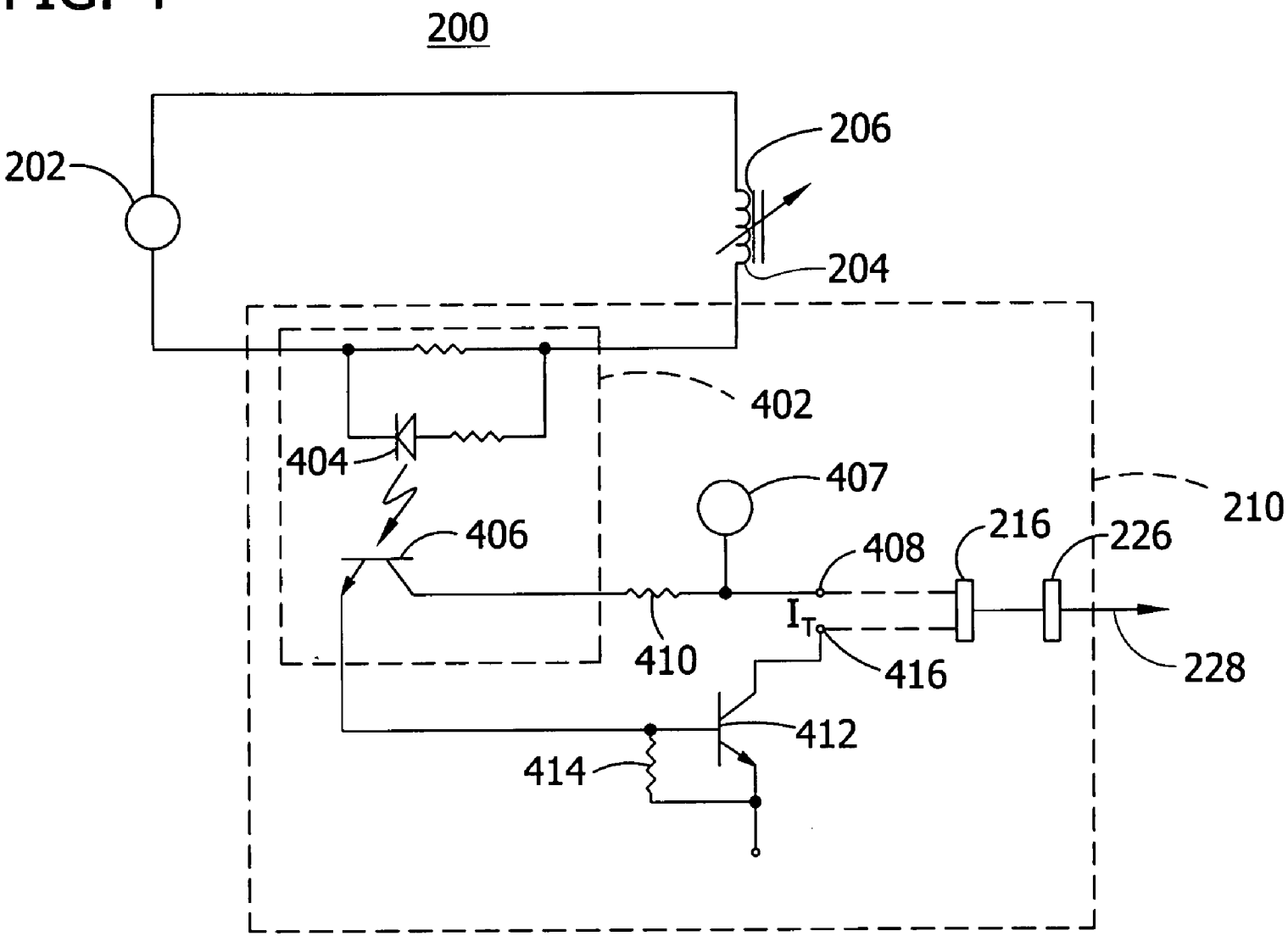
FIG. 4 is a schematic illustration of another load detection circuit suitable for use in one preferred embodiment of the invention.

Referring next to FIG. 4, a schematic diagram illustrates components of a load detection circuit 210 used in another preferred embodiment of the invention. When two circuits operate at different voltage levels, it may be desirable to isolate any link between the two circuits to prevent overvoltage damage to at least one of the circuits. In this embodiment, the detection circuit 210 includes an optocoupler 402 coupled to the switching circuit 200, and is used to isolate the switching circuit 200 from the detection circuit. As known to those skilled in the art, an optocoupler 402 comprises an optical transmitter such as a gallium arsenide light-emitting diode (LED) 404 and an optical receiver such as a phototransistor 406. The LED 404 and phototransistor 406 are separated by a transparent barrier which blocks any electrical current flow between the two, but does allow the passage of light. Phototransistors 406 are specially designed transistors with an exposed base region that is sensitive to light, especially when infrared source of light is used. Generally, phototransistors 406 include two leads: a collector and an emitter. When the base region is exposed to light, the phototransistor 406 is in an "on" condition and allows a current to flow from the collector to the emitter. However, when there is an absence of light the phototransistor 406 is in an "off" condition and current does not flow from the collector to the emitter. Because the LED 404 transmits light to transmit a signal across an electrical barrier, excellent circuit isolation can be achieved.

In this embodiment, the detection circuit 210 includes a DC voltage source 407 for supplying a DC voltage to the detection circuit 210 via terminal 408. Terminal 408 is coupled to the collector of the phototransistor 406 via a series load resistor 410. The load resistor 410 limits the amount of current that can flow through the transistor 406 when the phototransistor 406 is an "on" condition. When the current increases in the switching circuit 200 (e.g., the magnet 205 is within or near the magnetic amplifier coil 204), the LED 404 generates light pulses at the frequency of the ac signal being supplied via the generator 202. The phototransistor 406 is responsive to the generated light to allow current flow from its collector to its emitter. A NPN transistor 412 is connected to the emitter of the phototransistor and is responsive to the current flow from the emitter of the phototransistor 406 to allow current flow from its collector to its emitter. A resistor 414 is connected to the base and emitter and is used to provide a negative return for the emitter of 406 and to limit the current flowing into the base of the NPN transistor 412. The NPN transistor 412 operates as a current controlled switch that when closed, allows current to flow through a load connected between terminals 408 and 416 such as a relay 216. The relay 216 is responsive to the magnitude of the current ($I_T$) conducted by transistor 412 to open or close the relay 216. Alarm circuit 226 monitors the relay 216 to detect a closed circuit condition, and generates an alarm signal 228 when a closed circuit is detected. The alarm signal 228 can be used to activate visual and/or audible alarms such as a Hot Box Detector equipped with a Talker feature to transmit a voice alarm via radio, or an interconnection to the signal system to provide a visual alarm.

Figure 5:
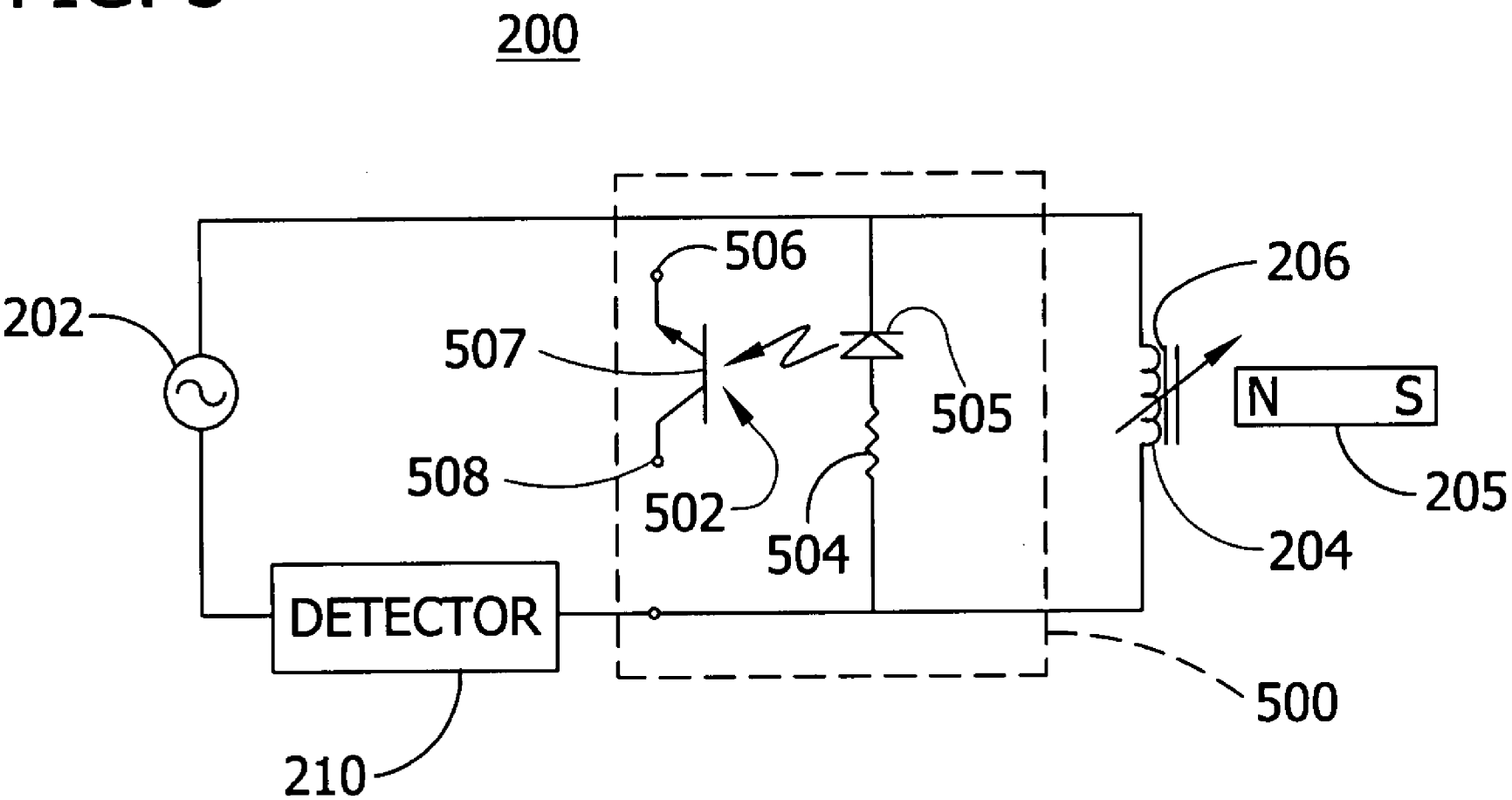
FIG. 5 is a schematic illustration of a test circuit suitable for use in one preferred embodiment of the invention.

Referring next to FIG. 5, a schematic diagram illustrates components of a test circuit 500 configured to provide confirmation of the operation of the switching circuit 200. In this embodiment, the test circuit 500 is coupled to the switching circuit 200 to produce an inverse output to verify that the contact-less switch mechanism (i.e., magnetic amplifier coil 204 and the magnet 205) is operable by comparison of the two diverse outputs. In addition to the components as describe above in reference to FIG. 2, the switching circuit 200 includes an optocoupler 502, and resistor 504 connected in parallel with magnetic amplifier coil 204. As described above, when the magnet 205 is located within or near the magnetic amplifier coil 204 (i.e., impact element in upward position), the impedance of the coil 204 decreases and increases the amount of current I flowing through the coil 204. Alternatively, when the magnet 205 is located away from the magnetic amplifier coil 204 (i.e., impact element in downward position), the impedance of the coil 204 increases and decreases the amount of current flowing through the coil 204. When the current flowing through the coil 204 decreases, the current flowing through optocoupler 200 increases, and when the current flowing through the coil 204 increases the current flowing through the optocoupler decreases. When the current flowing through the optocoupler 502 increases, the LED generates light and the phototransistor which is responsive to the generated light will turn "on" and allow current to flow from the collector to the emitter. Moreover, when the impedance of the coil increases, the current flowing the coil 204 is reduced substantially and, thus, minimal current, if any is provided to the detection circuit 210. As a result, the output of the optocoupler 502 should always be opposite of the output of the detection circuit 210. For example, when a high output (e.g., current flow) is detected between terminals 506 and 508, a low voltage output (e.g., zero volts) is generated by the detection circuit 210 because minimal, if any, current flows through the detection circuit 210. Conversely, when a low output (e.g., no current flow) is detected between terminals 506 and 508, a high voltage output (e.g., five volts) is generated by the detection circuit because there is an increase in the current flowing through the detection circuit 210. However, if there is a failure of components in the test circuit 500 or in the detection circuit 210, the output of the optocoupler 502 may be substantially the same as the output of the detection circuit 210. Accordingly, monitoring each circuit to determine if they are both producing an output, or if neither is producing and output, during any given state allows detection of improper circuit operation. For example, monitoring circuitry (not shown) can monitor and activate a separate alarm (not shown) if failure causes both outputs to agree during any given state.

Figure 6:
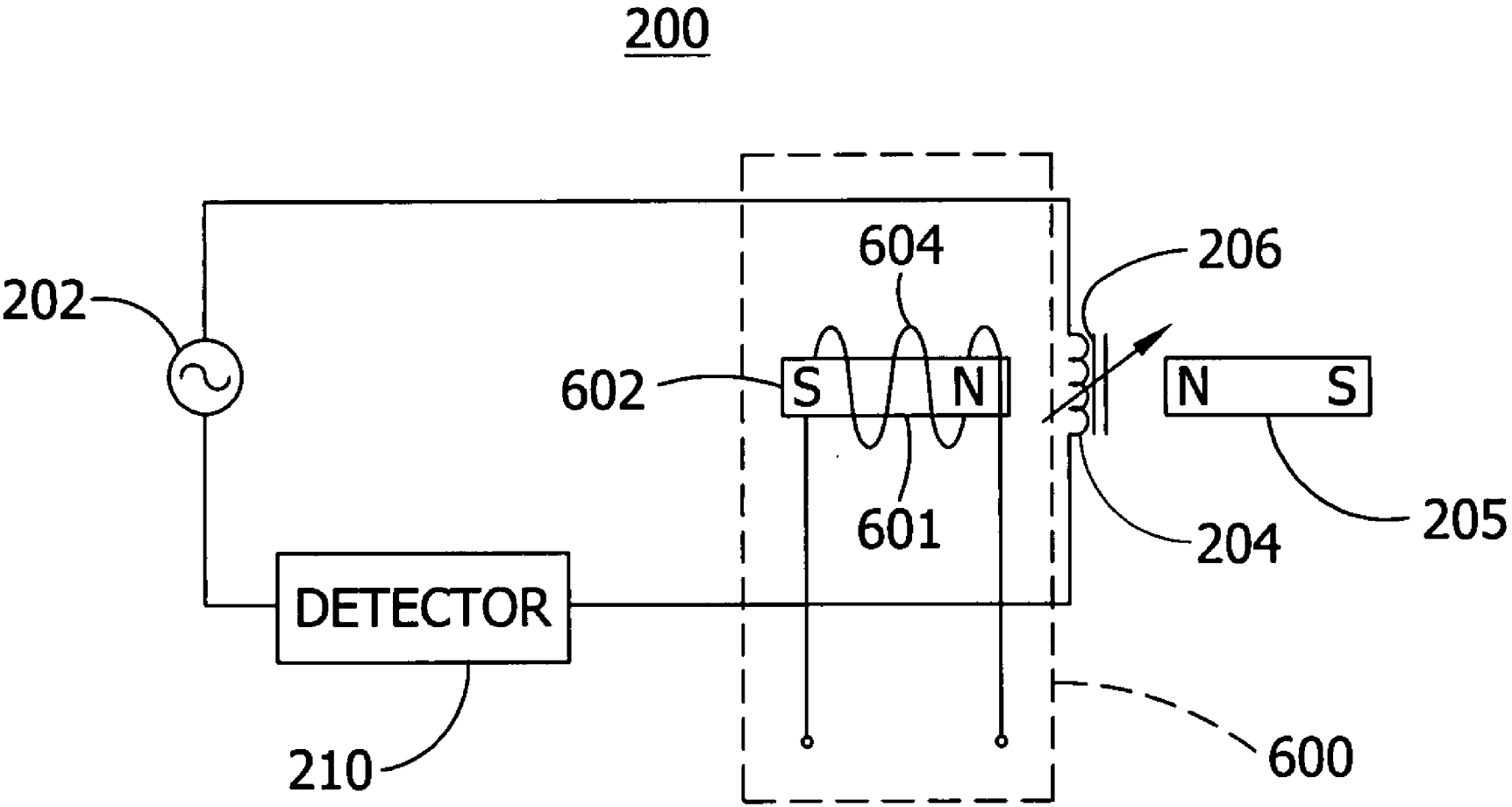
FIG. 6 is a schematic illustration of another test circuit suitable for use in one preferred embodiment of the invention.

Referring next to FIG. 6, a schematic diagram illustrates components of test circuit 600 configured to allow remote testing of the switching circuit 200. An electromagnet 601 is connected to the switching circuit 200 to facilitate testing of detection circuit 210. Current pulses are applied to a wire coil 604 associated with the electromagnet 601 to create a magnetic flux that opposes the flux associated with movable magnet 205. As a result, the current pulses can be used to drive the magnetic amplifier coil 204 out of saturation, so that the detection circuit 210 can detect the pulse. When the magnetic amplifier coil 204 is out of saturation, the impedance of the coil 204 increases, and decreases the amount of current, (I), flowing through the switching circuit 200. As described above in reference to FIG. 2, a reduced current through detector transformer generates a lower dc output voltage resulting in the relay contacts closing, and the alarm circuit 226 detects a closed circuit and generates an alarm signal 228 that can be used to activate visual and/or audible alarms. Conversely, when permanent magnet 205 is moved away from the magnetic amplifier core 204, so that it is out of saturation, current pulses can also be applied to the wire coil 604, to drive core 204 back into saturation. Thus, detection circuit 210 may be remotely forced to change states with test pulses, regardless of the position of the permanent magnet 205. In other words, proper operation of the detection circuit can be verified whether the impact element is in an upward position (i.e., magnet positioned near the core of the magnetic amplifier coil) or in a downward position (i.e., magnet positioned away from the core of the magnetic amplifier coil).

Figure 7:
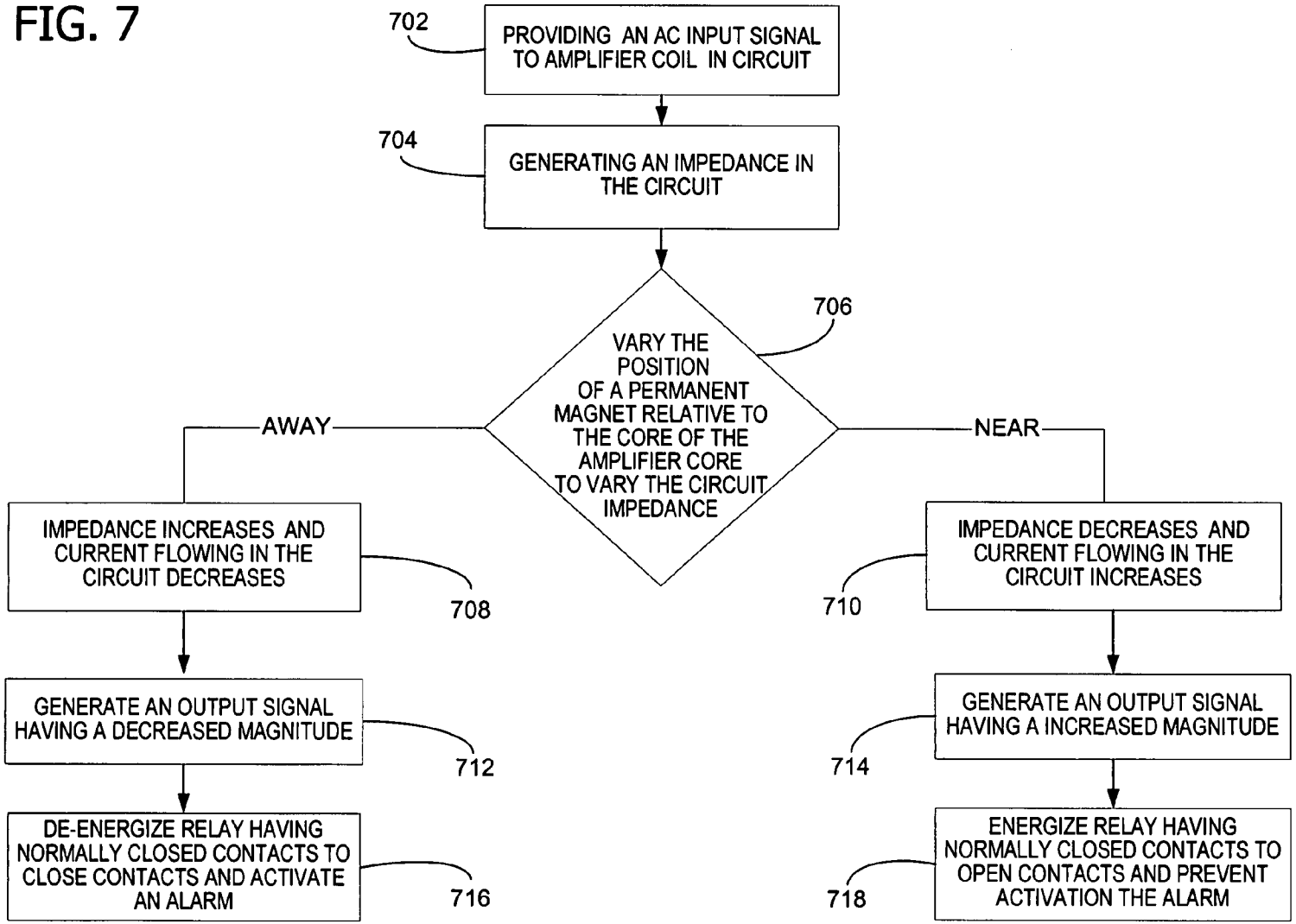
FIG. 7 is a flow chart illustrating one method for detecting mechanical movement of an object suitable for use in one embodiment of the present invention.

Referring now to FIG. 7, a flow chart illustrates one method for detecting mechanical movement of an object suitable for use in one embodiment of the present invention. At 702, an ac voltage signal is provided to a circuit having a magnetic amplifier coil. The magnetic amplifier coil is wound on a magnetic amplifier core 204 and is responsive to the generated ac voltage signal to affect an impedance of the circuit at 704. At 706, the location of a magnetic field associated with a permanent magnet is varied relative to the magnetic amplifier core 204 to vary the impedance of the circuit. As described above in reference to FIG. 2, the magnet can be mechanically connected to a cam/follower system for varying the location of the magnet relative to the magnetic amplifier core 204 when an impact element rotates from a first position to a second position. If the cam/follower system moves the magnet away from the magnetic amplifier core at 706, the impedance of the circuit increases, which decreases the amount of current flowing in the circuit at 708. If the cam/follower system moves the magnet near or within the magnetic amplifier core at 706, the impedance of the circuit decreases, which increases the amount of current flowing in the circuit at 710. An output voltage signal is generated by a detection circuit as a function of the amount of current flowing in the circuit. If a decreased amount of current is flowing in the circuit at 708, the detection circuit generates an output voltage signal having a decreased magnitude (e.g., o volts) at 712. If an increased amount of current is flowing in the circuit at 710, the detection circuit generates an output voltage signal having an increased magnitude (e.g., 5 volts) at 714. In this example, the magnitude of the output voltage signal determines whether an alarm will activate. For example, the magnitude of the generated output signal determines whether a relay having normally closed contacts is de-activated causing the contacts to close, which activates an alarm. Thus, if the generated output signal has a decreased magnitude at 712, the relay de-energizes (i.e., closes) to activate the alarm at 716. If the generated output signal has an increased magnitude at 714, the relay is energized (i.e., opens) to prevent activation the alarm at 718.

Although the invention is described above for use in connection with a DED system, it is contemplated that the invention can be used with other mechanical switching mechanisms such as a switch machine described in commonly owned U.S. Pat. No. 6,691,958 to Biagiotti. As known to those skilled in the art, switching machines are used to interconnect railroad switch points. A railroad switch point consists of tapered rail sections capable of being selectively displaced between two different positions at a rail switch and then locked in the selected position, in order to facilitate the desired routing of a train passing through the switch. The two switch points are typically displaced by rods that extend from an assembly referred to as a "switch machine." The rods are usually connected to a motive mechanism (not shown), which provides reciprocating rectilinear motion, controlled by a power unit usually placed to one side of the rails. Similar to the DED system, the motive mechanism houses a follower mechanism that can be used to identify the position of the rod. That is, a first position of the follower indicates that the switch points are locked in a first position, and a second position of the follower indicates that the switch points are locked in a second position. By employing the contact-less switch of the invention, the position of a tapered rail section with respect to the two switch points can be determined. For example, in the cam follower configured to move a magnet relative to an amplifier coil, to detect the position the position of the operating rods, and thus determine the route of the train through the switch.

When introducing elements of the present invention or preferred embodiments thereof, the articles a, an, the, and said are intended to mean that there are one or more of the elements. The terms comprising, including, and having are intended to be inclusive and mean that there may be additional elements other than the listed elements.

In view of the above, it will be seen that several aspects of the invention are achieved and other advantageous results attained.

As various changes could be made in the above exemplary constructions and methods without departing from the scope of the invention, it is intended that all matter contained in the above description or shown in the accompanying drawings shall be interpreted as illustrative and not in a limiting sense. It is further to be understood that the steps described herein are not to be construed as necessarily requiring their performance in the particular order discussed or illustrated. It is also to be understood that additional or alternative steps may be employed with the present invention.

The invention claimed is:

1. An apparatus for use with a railroad dragging equipment detecting (DED) system that detects objects hanging from and dragged beneath a train as the train travels along rails of a railroad track, said DED system having an impact element fixedly mounted to a shaft extending generally between the rails, wherein the impact element includes at least one surface that is impacted by an object hanging down from said train to the impact surface when the train and object pass the impact element, and wherein the impact element rotates from a first position to a second position, and wherein a cam/follower system translates the rotational motion of the impacted element to a linear movement, said apparatus comprising:

a signal generator for supplying an input signal;

a magnetic amplifier coil coupled to the signal generator to form a circuit which is responsive to the supplied input signal to affect an impedance of the circuit, said magnetic amplifier coil comprising a coil being wound on a magnetic amplifier core;

a magnet generating a magnetic field positioned near the magnetic amplifier core for varying the impedance in the circuit, said magnet fixedly mounted to the cam/follower system, wherein said cam/follower system moves the magnet relative to the magnetic amplifier coil when the impact element rotates from the first position to the second position, and wherein moving the magnet varies the circuit impedance;

a detection circuit for generating an output signal as a function of variations in circuit impedance; and a controller responsive to the output signal for activating an alarm when the magnet moves relative to the magnetic amplifier coil.

2. The apparatus of claim 1 wherein the magnet is positioned substantially near or within the magnetic amplifier core when the impact element is in the first position to decrease the circuit impedance, and wherein the magnet is positioned away from the magnetic amplifier core when the impact element is in the second position to increase the circuit impedance.

3. The apparatus of claim 1 wherein the detection circuit includes a transformer coupled to the magnetic amplifier coil, said transformer having a primary winding and secondary winding, wherein said primary and secondary windings are configured to step up a primary voltage across the primary winding to produce a secondary voltage across the secondary winding, wherein the magnitude of the secondary voltage has a first magnitude when the impedance of the circuit is decreased and has a second magnitude when the impedance of the circuit is increased, said first magnitude being greater than the second magnitude, and wherein the controller is responsive to a secondary voltage having the second magnitude for activating the alarm.

4. The apparatus of claim 1 wherein the detection circuit includes an optocoupler coupled to the magnetic amplifier coil, said optocoupler responsive to a first current in the amplifier coil to produce a second current in the detection circuit, wherein the detection circuit is responsive to the second current to produce the output signal, and wherein the magnitude of the output signal has a first magnitude when the impedance of the circuit is decreased and a second magnitude when the impedance of the circuit is increased, said first magnitude being greater than the second magnitude, and wherein the controller is responsive to an output signal having the second magnitude for activating the alarm.

5. The apparatus of claim 1 wherein the detection circuit generates an output signal having a first magnitude when the magnet is positioned substantially near or within the magnetic amplifier core, and generates an output signal having a second magnitude when the magnet is positioned away from the magnetic amplifier core, said second magnitude of the output signal being greater than the first magnitude of the output signal, wherein the controller is responsive to the output signal having the first magnitude for not activating the alarm circuit, and wherein the controller is responsive to the output signal having the second magnitude for activating the alarm circuit.

6. The apparatus of claim 1 wherein the alarm is a visual and/or audible alarm.

7. The apparatus of claim 1 wherein the magnetic amplifier coil and the magnet operate as a contact-less switching mechanism.

8. The apparatus of claim 1 wherein the controller is a relay.

9. The apparatus of claim 1 further including a test circuit coupled to the circuit for generating a test signal, said test signal being indicative of whether the circuit is operable.

10. The apparatus of claim 9 wherein the test circuit includes an optocoupler connected in parallel with the magnetic amplifier coil, said optocoupler being responsive to a received current to generate a test signal, said received current being inversely proportional to an amount of current flowing in the magnetic amplifier coil, wherein the magnitude of the test signal is low and the magnitude of the output signal is high when the impedance of the circuit decreases, and wherein the magnitude of the test signal is high and magnitude of the second signal is low when the impedance of the circuit increases.

11. The apparatus of claim 9 wherein the test circuit includes an electromagnet, said electromagnet including a permeable iron core positioned within a wire coil, wherein the electromagnet is responsive to a test current pulse being applied to the wire coil to create a different magnetic field which opposes the magnetic field associated with the movable magnet to the circuit impedance, and wherein the detection circuit generates a test signal as a function of the varied circuit impedance, and wherein the relay is responsive to the test signal for activating the alarm when the current pulse is applied to the electromagnet.

12. The apparatus of claim 11 wherein the test current pulse applied to the electromagnet decreases the circuit impedance when the movable magnet is positioned away from the magnetic amplifier core, and wherein the test current pulse applied to the electromagnet increases the circuit impedance when the movable magnet is positioned near or within the magnetic amplifier core.

13. The apparatus of claim 1 wherein the circuit includes two conductors connecting the signal generator to the magnetic amplifier coil.

14. An apparatus for detecting a position of a switching mechanism, said switching mechanism indicating a position of an object having a first position and a second position, said apparatus comprising:

a signal generator for supplying an input signal;

a magnetic amplifier coil coupled to the signal generator to form a circuit which is responsive to the supplied input signal to affect an impedance of the circuit, said magnetic amplifier coil comprising a coil being wound on a magnetic amplifier core;

a magnet located near the magnetic amplifier core for varying the impedance of the circuit, said magnet mechanically connected to the switching mechanism, wherein the magnet has a first location relative to the magnetic amplifier coil when the object is in the first position and has a second location relative to the magnetic amplifier coil when the object is in the second position, and wherein the impedance of the circuit when the magnet is in the first location is different than the impedance of the circuit when the magnet is in the second location and wherein the switching mechanism is associated with a dragger-equipment detection system;

a detection circuit for generating an output signal as a function of variations in circuit impedance; and a controller responsive to the output signal for activating an alarm when the magnet moves relative to the magnetic amplifier coil.

15. The apparatus of claim 14 wherein the magnet is located substantially near the magnetic amplifier core when the object is in the first position to decrease the circuit impedance, and wherein the magnet is located away from the magnetic amplifier core when the object is in the second position to increase the circuit impedance.

16. The apparatus of claim 14 wherein the detection circuit includes a transformer coupled to the magnetic amplifier coil, said transformer having a primary winding and a secondary winding, wherein said primary and secondary windings are configured to step up a primary voltage across the primary winding to produce a secondary voltage across the secondary winding, wherein the magnitude of the secondary voltage has a first magnitude when the impedance of the circuit is decreased and a second magnitude when the impedance of the circuit is increased, said first magnitude being greater than the second magnitude, and wherein the controller is responsive to a secondary voltage having the second magnitude for activating the alarm.

17. The apparatus of claim 14 wherein the detection circuit generates an output signal having a first magnitude when the magnet is located substantially near the magnetic amplifier core, and generates an output signal having a second magnitude when the magnet is located away from the magnetic amplifier core, said first magnitude of the output signal being greater than the second magnitude of the output signal.

18. The apparatus of claim 17 wherein the controller is responsive to the output signal having the first magnitude for not activating the alarm circuit, and wherein the controller is responsive to the output signal having the second magnitude for activating the alarm circuit.

19. The apparatus of claim 14 wherein the alarm is a visual and/or audible alarm.

20. The apparatus of claim 14 wherein the switching mechanism is associated with a switching machine controlling a route of a railway vehicle traveling along rails of a railroad track.

21. The apparatus of claim 14 wherein the circuit includes two conductors connecting the signal generator to the magnetic amplifier coil.

22. A method for detecting a position of a switching mechanism, said switching mechanism indicating position of an object having a first position and a second position, said method comprising:

supplying an input signal to a circuit, said circuit including a magnetically variable inductor responsive to the input signal, said variable inductor affecting an impedance of the circuit;

varying a location of a magnetic field relative to the magnetically variable inductor to vary the circuit impedance, wherein the magnetic field has a first location relative to the variable inductor when the object is in the first position and has a second location relative to the variable inductor when the object is in the second position, and wherein the impedance of the circuit when the magnetic field is in the first location is different than the impedance of the circuit when the magnetic field is in the second location;

generating an output signal as a function of variations in the circuit impedance;

selectively activating an alarm as a function of the generated output signal; and supplying a current pulse to an electromagnet to produce an additional magnetic field opposing the magnetic field, wherein supplying the current pulse increases the circuit impedance to generate an output signal having the second magnitude when the first magnetic field is located near the variable inductor, and wherein supplying the current pulse decreases the circuit impedance to generate an output signal having the first magnitude when the first magnetic field is located away from the variable inductor.

23. The method of claim 22 wherein varying the location of the magnetic field includes locating the magnetic field near the magnetically variable inductor when the object is in the first position to decrease the circuit impedance, and locating the magnetic field away from the variable inductor when the object is in the second position to increase the circuit impedance.

24. The method of claim 22 wherein the generated output signal has a first magnitude when the impedance of the circuit is decreased and a second magnitude when the impedance of the circuit is increased, said first magnitude corresponding to a low magnitude, and said second magnitude corresponding to a high magnitude, and wherein the selectively activating the alarm includes activating the alarm when the generated output signal has the second magnitude.

25. The method of claim 24 further including:

generating a test output signal as a function of the circuit impedance;

comparing a magnitude of the test signal to the magnitude of the generated output signal to determine if varying the location of the magnetic field affects the impedance of the circuit, wherein the magnitude of the test output signal is low when the impedance of the circuit is decreased, and wherein magnitude of the test output signal is high when the impedance of the circuit is increased; and wherein varying the location of the magnetic field is determined to affect the impedance of the circuit when the magnitude of generated output signal is high and the magnitude of the test signal is low, or when the magnitude of the generated output signal is low and the magnitude of the test signal is high, and wherein varying the location of the magnetic field is determined not to affect the impedance of the circuit when the magnitudes of generated output signal and the test signal are substantially the same.

26. An apparatus for detecting a position of a switching mechanism, said switching mechanism indicating a position of an object having a first position and a second position, said apparatus comprising:

a signal generator for supplying an input signal;

a magnetic amplifier coil coupled to the signal generator via a first conductor and a second conductor to form a circuit which is responsive to the supplied input signal to affect an impedance of the circuit, said magnetic amplifier coil comprising a coil being wound on a magnetic amplifier core;

a magnet located near the magnetic amplifier core for varying the impedance of the circuit, said magnet mechanically connected to the switching mechanism, wherein the magnet has a first location relative to the magnetic amplifier coil when the object is in the first position and has a second location relative to the magnetic amplifier coil when the object is in the second position, and wherein the impedance of the circuit when the magnet is in the first location is different than the impedance of the circuit when the magnet is in the second location;

a detection circuit for generating an output signal as a function of variations in circuit impedance;

a controller responsive to the output signal for activating an alarm when the magnet moves relative to the magnetic amplifier coil; and wherein the magnetic amplifier coil and magnet operate as a contact-less switching mechanism of a dragger-equipment detection system to vary current flow in the circuit.

27. The apparatus of claim 26 wherein the magnetic amplifier coil and magnet are used to replace an existing contact switching mechanism in the circuit.

* * * * *